United States Patent [19]

Hadermann et al.

[11] Patent Number: 4,981,535

[45] Date of Patent: Jan. 1, 1991

[54] PROCESS FOR MAKING FINELY DIVIDED SOLIDS

[75] Inventors: Albert F. Hadermann, Ijamsville, Md.; Paul F. Waters, Washington, D.C.; Jerry C. Trippe, Fairfax Station, Va.

[73] Assignee: General Technology Applications, Inc., Manassas, Va.

[21] Appl. No.: 790,374

[22] Filed: Sep. 4, 1985

Related U.S. Application Data

[63] Continuation-in-part of Ser. No. 429,622, Sep. 30, 1982.

[51] Int. Cl.[5] ..... C06B 21/00

[52] U.S. Cl. ..... 149/19.92; 34/36; 241/23; 241/DIG. 37

[58] Field of Search ..... 149/19.92, 19.93; 34/36, 46.1; 241/23, DIG. 37

[56] References Cited

U.S. PATENT DOCUMENTS

| | | | |
|---|---|---|---|
| 3,441,455 | 4/1969 | Woods et al. | 149/19.92 |
| 3,462,952 | 8/1969 | D'Alelio | 149/19.92 |
| 3,651,008 | 3/1972 | Moser et al. | 149/19.92 |
| 3,685,163 | 8/1972 | Olt | 149/19.92 |
| 3,740,279 | 6/1973 | Levering et al. | 149/19.91 |
| 3,892,610 | 7/1975 | Huzinec | 149/19.92 |
| 4,021,378 | 5/1977 | Frisch et al. | 260/2.5 BE |
| 4,036,944 | 7/1977 | Blytas | 423/648 R |
| 4,315,884 | 2/1982 | Van Gasse | 264/255 |
| 4,340,676 | 7/1982 | Weitzen | 137/13 |
| 4,440,916 | 4/1984 | Waters et al. | 525/54.2 |
| 4,483,807 | 11/1984 | Asano et al. | 264/22 |

FOREIGN PATENT DOCUMENTS 762437 7/1967 Canada .

OTHER PUBLICATIONS

DTIC Tech. Rep. #AD 516,625, "Low Shear Mixing", Hercules Inc., Tech. Rep. AFRPL-TR-71-101 (Jul. 1971).

*Primary Examiner*—Edward A. Miller
*Attorney, Agent, or Firm*—Roland H. Shubert

[57] ABSTRACT

Solid particles of microscopic size are mixed in a nitrogen atmosphere at conditions of pressure and temperature such that at least a monolayer of nitrogen molecules is adsorbed on the particle surfaces but at conditions at which liquid nitrogen cannot exist in the mixture.

24 Claims, 1 Drawing Sheet

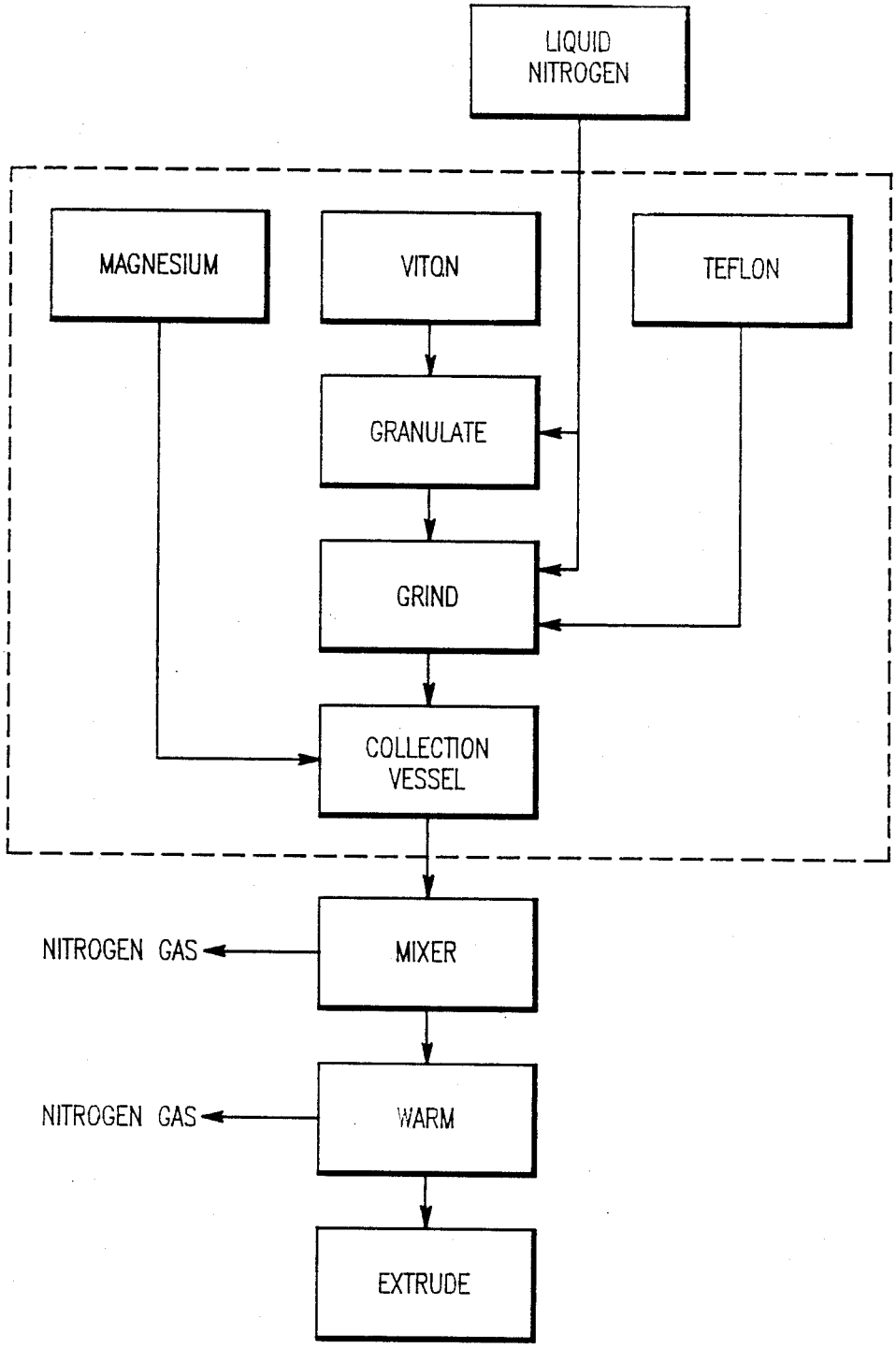
LIQUID NITROGEN
MAGNESIUM
VITON
TEFLON
GRANULATE
GRIND
COLLECTION VESSEL
NITROGEN GAS
MIXER
NITROGEN GAS
WARM
EXTRUDE

PROCESS FOR MAKING FINELY DIVIDED SOLIDS

CROSS REFERENCE TO RELATED APPLICATIONS

This application is a continuation-in-part of U.S. Patent Application Ser. No. 429,622, filed Sept. 30, 1982.

BACKGROUND OF THE INVENTION

This invention relates generally to a process for mixing finely divided solid particles.

More particularly, this invention relates to a process for obtaining homogeneous admixtures of two or more unlike and microscopically divided solid substances.

In a specific embodiment, this invention relates to a process for obtaining homogeneous admixtures of pyrotechnic and explosive compositions and forming consolidated shapes therefrom.

It is notoriously difficult to obtain homogeneous mixtures of finely divided solids by conventional dry mixing techniques. As a general rule, the more finely divided the solids are, the more difficult it is to obtain a uniform mixture. Further, differences in particle size, particle shape and specific gravity increase the difficulties in obtaining uniform mixtures.

Even so, compositions comprising consolidated or bonded admixtures of a great variety of unlike particulate materials find substantial commercial and military use. Examples include structural shapes, friction products such as brake pads and clutch facings, pyrotechnic compositions including military rocket motor igniters, polymer bonded explosives, gun propellants and rocket propellants. These examples may be generally characterized as containing a high loading of solid substances including inorganic fillers, fibers, metals and abrasives, inorganic oxidizing salts such as ammonium nitrate and ammonium perchlorate, organic oxidizing and explosive compounds and the like, all bound or bonded by polymers, elastomers and other matrix materials.

A variety of common industrial processes require the mixing or blending of solids with reactive liquids. It is usually necessary to accomplish the mixing or blending before substantial reaction of the liquid occurs. Typical of these processes are those which blend solid materials, often at high loadings, with a monomer of liquid prepolymer, which later reacts to form a solid matrix.

Compounding products containing high solids loadings is often accomplished by use of mechanical mixers which produce a high shear, kneading type of action. These severe mixing conditions are necessary to evenly disperse the solid particles throughout the prepolymer or monomer and to thoroughly wet each of the particles with the liquid. Mixing times are usually prolonged, ranging from many minutes to several hours. Brittle fibers such a glass, graphite or some metal whiskers can not be incorporated into composites by these mixing techniques as they are broken even to the point of being reduced to dust by the severity of the shearing action during compounding. Consequently, brittle fibers are typically incorporated into structural composites as woven fabrics or as mats made by depositing chopped roving onto a conveyor, spraying a binder to hold the fibers in a random arrangement, and heat setting the binder as the conveyor passes through an oven.

The manufacture of polymer bonded rocket propellants and explosives presents an extreme challenge to the compounding art. Solids loading is extremely high, typically above about 85% and desirably above about 90%. The composites must withstand cycling over a large temperature range without cracking or degrading and must have enough strength and resilience to withstand high vibrational and accelerative loads. Dispersion of the solid materials throughout the polymer matrix must be very uniform in order to ensure an uniform burning rate.

Polymer bonded propellants and explosives are typically prepared batch-wise by adding the solids, mainly oxidizers such as ammonium nitrate or perchlorate, or energetic explosives such as RDX, to a liquid prepolymer in a Banbury or similar intensive kneading type of mixer. In one specific process for producing a polymer bonded explosive, five separate mixing cycles are used with staged addition of components during the cycles. Total mixing time for this particular process is in excess of five hours. As can be appreciated, pot life of the mixture is a critical parameter as it must be cast into the desired shape after mixing. Consequently, the polymerization or cross-linking reactions must be held to a very low rate which, in turn, necessitates extremely long cure times for the cast shapes.

There have been attempts made in the past to compound formulations, especially reactive formulations at cold temperatures. For example, Canadian Patent No. 762,437 discloses the preparation of storage-stable compositions containing one or more components which are spontaneously reactive at room temperature. Epoxy adhesive compositions are typical of those disclosed in the patent. The technique employed involved separately freezing an epoxy resin and an epoxy hardener by immersion in liquid nitrogen. Each component was thereafter pulverized and the resulting powders were blended together in liquid nitrogen and were stored for extended periods of time in liquid nitrogen without loss of reactivity upon warming.

A recently declassified report, DTIC Technical Report No. AD516,625, "Low Shear Mixing", Hercules, Inc., Technical Report AFRPL-TR-71-101, July 1971 (Declassified and published February 1984), summarizes the results of a literature search of low shear mixing processes for preparation of a literature search of low shear mixing processes for preparation of propellant compositions. One of the processes described in the report is called "Solid Phase Mixing". As described in the report, solid phase mixing involves the solidification of liquid ingredients by freezing, blending all ingredients while in a finely divided or granular state, casting the blended ingredients, then thawing and curing in the mold. Ingredient addition, mixing and casting are all performed in a vacuum environment to avoid moisture contamination.

The authors of the report, the Bacchus Works of Hercules, Inc., were the same group as did the original demonstration work on the "Solid Phase Mixing" process. The report concluded that the "Solid Phase Mixing" technique was but partially successful and that the blending of various sized solid particles of different densities and loading them into a mold to obtain an intimate mixture was extremely difficult because of segregation due to differences in particle densities and sizes. It was recommended that further work be directed to the preparation of propellant mixes using an inert liquid diluent to lower viscosity, reduce the mixing shear, minimize sensitivity and provide a moisture barrier. At the conclusion of the mixing operation, the propellant mix was to be frozen and granulated. Diluent would then be removed by a freeze drying process and the resulting diluent-free granules were to be cast into a cold mold under vacuum conditions.

U.S. Pat. No. 4,177,227 to Harvey et. al., describes and claims a process similar to that recommended in the DTIC report. Patentees prepare high solids, high viscosity rocket propellants by blending the ingredients with an inert diluent so that mixing can be accomplished at low shear conditions. The mixture is then frozen and granulated after which the diluent is removed by freeze drying. Diluent-free granules are then loaded into a mold under vacuum conditions to consolidate and cure the composition to produce a high solids loaded solid rocket propellant. As can be appreciated, the required freeze drying step is very energy intensive and is difficult to carry out on a large scale. Methylene chloride is the preferred diluent because it exhibits favorable removal characteristics by the freeze dry process and because it is non-flammable. However, it is now recognized that methylene chloride is also a health hazard if breathed by personnel which necessitates added care and expense in practicing the patented process.

SUMMARY OF THE INVENTION

It has been found that uniform mixtures of solid, microscopic particles of two or more unlike substances may be obtained by simple physical admixing provided that certain critical conditions are maintained during the mixing step. The particles of each substance must be dispersed in cold nitrogen gas and the physical admixing must be carried out at conditions of temperature and pressure whereat no liquid nitrogen exists but whereat there is adsorbed on the particles surfaces at least a monolayer of nitrogen gas. The adsorbed nitrogen gas layer on the particle surfaces acts to maintain the particles in a non-agglomerating, free-flowing state which allows mixing to be accomplished by simple tumbling. The resulting mixture may be maintained in a stable, non-segregated state by changing the temperature and pressure conditions, i.e., raising the temperature, lowering the pressure, or both, so that the nitrogen layer on the particle surfaces desorbs and adhesive forces between adjacent particles effectively preclude segregation of the various substances. After raising the temperature of the mixture to ambient, preferably while maintaining a protective nitrogen atmosphere to preclude contamination by water vapor or other reactive agents, the mixture may be handled, transported and subjected to further processing, including forming by extrusion and other methods, without segregation occuring.

Hence, it is an object of this invention to provide a process for mixing microscopic particles of two or more unlike solid substances.

It is another object of this invention to obtain homogeneous pyrotechnic compositions by mixing microscopic particles of the substances contained in the pyrotechnic composition and thereafter forming a consolidated shape by subjecting the mixture to heat and pressure.

A specific object of this invention is to provide a process for the manufacture of magnesium-Teflon-Viton rocket igniter compositions.

Yet another specific object of this invention is to provide a process for the manufacture of low vulnerability ammunition and rocket fuels.

Other objects of this invention will be evident from the following description of certain specific embodiments of the invention.

DESCRIPTION OF THE DRAWING

The single figure is an illustrative flow sheet showing the manufacture of the rocket igniter material commonly referred to as MTV in accordance with this invention.

DESCRIPTION AND DISCUSSION OF THE INVENTION

The process of this invention is directed to the mixing of solid particles of microscopic size of two or more unlike substances in the absence of liquid. Because the process necessarily is carried out at relatively low temperatures, it includes those substances which are liquid (or even gas) at room temperature but which are solid and can be formed into microscopic sized particulates at the processing conditions of this invention.

The adhesion of particles, both one to another and to solid surfaces, is well known and is the subject of considerable study. These phenomena are strongly influenced by particle size, shape and the properties of the ambient medium, Coulomb interaction, the electrical double layer formed in the contact zone, and other causes. As the size of particles decrease, there is reached a point at which the forces interacting between particles is equal to or greater than the particle weight, resulting in agglomeration of two or more particles to form, in effect, a larger particle. It is the mixing of particles of that size or smaller to which this invention is directed.

For the purpose of this disclosure, the definition of "microscopic" proposed by Anatolii D. Zimon in his book, "Adhesion of Dust and Powder", second edition, (translated from the Russian by Robert K. Johnson and published by the Consultants Bureau, New York, 1982) will be adopted. Zimon, in his introductory chapter, quantifies the dimensions of "microscopic particle" in terms of the particles themselves, the properties of contiguous solids and the properties of the ambient medium. Zimon rather arbitrarily limits the minimum particle size by analogy with the minimum sizes of colloidal particles, or $10^{-1}$ cm. The upper limit of particle size is more difficult to unambiguously define but is set at that size for which the force of interaction with a plane surface is larger than is the particle weight. That is, if the forces of adhesive interaction are large enough to cause a particle to stick to a plane surface, that particle is of microscopic size. In a practical dimensional sense, microscopic particles will generally be smaller than $10^{-2}$ cm in diameter. Very small particles, less than about $10^{-3}$ cm, adhere so strongly to surfaces that forces corresponding to accelerations of the order of $10^3$ to $10^4$ g-units are often not sufficient to overcome the adhesive force.

The properties of the ambient medium influence the forces of adhesion to a great degree. As a general rule, the forces of adhesion between particles are considerably smaller when they are immersed in liquids than in air because electrical and capillary forces are reduced, molecular forces are decreased and additional repulsive forces are present. When vapor of any liquid is present in a gas medium, vapor may condense between contiguous particles forming a liquid bridge and binding the particles together through capillary forces. Vacuum may either increase or decrease adhesive interaction between particles and other surfaces depending upon the conditions of particle interaction. If contact of the particle occurs at vacuum conditions, adhesion is generally greater than it would be in air. Particles tend to strongly adhere to each other under high vacuum conditions. For example, particles found on the lunar surface, having a diameter of about $10^{-2}$ cm, adhere strongly to clothing and other objects. Under normal earth conditions, particles of that size are easily removed from clothing by a vacuum cleaner. Under lunar conditions, however, these same particles cannot be removed by any suction technique.

Applicants have found that the adhesive forces between particles can effectively be negated allowing physical admixing of microscopic particles without agglomeration provided that the ambient medium is properly chosen and that certain conditions of temperature and pressure are rigorously observed during the mixing steps. The inventive process requires use of an inert, non-polar gas having a critical temperature below about −100 degrees C. so that at least a monolayer of gas molecules can be adsorbed on the particle surfaces in the total absence of liquid which would induce capillary forces between particles. These requirements limit the choice of the gaseous medium to only a very few candidates. In a practical sense, the process is limited to the use of nitrogen although helium, argon and certain other more exotic gases may at least in theory be used with at least some particle systems.

To carry out the inventive process, it is necessary to disperse the microscopic particles of each substance in nitrogen at conditions of temperature and pressure whereat at least a monolayer of nitrogen adsorbed on the particle surfaces. The physical adsorbtion of nitrogen on the surfaces of solids is well documented. It forms the basis for the determination of the surface area of finely divided particles by the method of Brunauer, Emmett and Teller; commonly referred to as BET surface area. As nitrogen, or any other gas is adsorbed on the surface of a solid, the adsorbed gas layer will act in some degree as an extension of the solid. At higher relative nitrogen pressures the monolayer will attract further molecules from the gas phase resulting in an adsorbed layer several molecules thick. As all of the particles in the system have this same mono to multi layer of adsorbed nitrogen, the effect is to cancel completely those adhesive forms, primarily electrical forces which arise upon particle-particle contact. The layers of adsorbed nitrogen act to keep the actual particles a finite distance apart. Consequently, molecular and coulomb forces, which decrease with increasing distance between contiguous surfaces are greatly lessened as well. When in this condition, that is with an adsorbed mono to multi layer of nitrogen, the microscopic particles intermix and flow freely thus allowing a homogeneous admixture to be easily formed; even by simple tumble mixing. Thereafter, conditions of pressure and temperature can be changed to destroy or remove the adsorbed nitrogen layer either by reducing the pressure, increasing the temperature, or both. As the adsorbed nitrogen layer is removed from the particles, adhesive forces again come into play between adjacent particles effectively stabilizing the mass of particles in an intermixed form.

Referring now to the drawing, the FIGURE illustrates an exemplary use of the inventive process to produce pyrotechnic MTV compositions. In order to appreciate the advantages offered by the process of this invention, it is necessary first to understand the present methods employed to produce such compositions. As described in publication AIAA-82-1189, "Investigation of Pyrotechnic MTV Compositions for Rocket Motor Igniters," authored by A. Peretz, Armament Development Authority, Haifa, Israel, MTV preparation is time consuming and cumbersome. Viton A, a fluorinated elastomer comprising a copolymer of vinylidene fluoride and hexafluoropropylene, is dissolved in acetone to form a relatively dilute solution; a procedure which takes some 48 hours to complete. This solution is added to a binary mixture of magnesium and Teflon powders and the mass is agitated Teflon is a trademark for tetrafluoroethylene fluorocarbon polymers. After a uniform dispersion is obtained, a quantity of a non-polar solvent, typically hexane, is added causing the Viton to precipitate out on and around the other particles. The solid product is washed with additional non-polar solvent and is finally formed into a desired shape through a variety of fabricating procedures. Reproducibility is low, lot-to-lot variability is high and quality control is extremely difficult.

In contrast, the process of this invention provides a high degree of reproducibility, uses no solvent and produces a superior product. Referring again to the FIGURE, it is preferred that all of those process steps within the bounds of the dashed outline be conducted in a nitrogen atmosphere. Magnesium is available as a finely divided spherical powder which disperses readily. It may be added directly to the collection vessel which is adapted to maintain the temperature of its contents near the normal boiling point of liquid nitrogen. The Viton elastomer is obtained in a relatively massive form and must first be granulated to obtain an appropriate feed for the grinding step. The Viton is granulated to a particle size convenient for grinding, typically to $-\frac{1}{8}$ in. Granulation is preferably carried out in the presence of liquid nitrogen which embrittles the Viton. Granulated Viton is next feed to a grinding means which may be a pin mill, a hammer mill, or the like. Grinding is accomplished at liquid nitrogen temperatures with liquid nitrogen added to the mill. The mill discharges directly into the collection vessel containing magnesium powder.

Teflon is obtained as a very finely divided powder having a consistency of a loose, moist clay. This powder must be dispersed in a mono-particulate form and dispersion may readily be accomplished by feeding the agglomerated powder at a slow rate through a mill together with a stream of liquid nitrogen. The action of the mill, with the intense swirling action of the cold nitrogen gas, is effective to break up the agglomerates of Teflon powder. Little or no comminution of the Teflon powder occurs within the mill as the Teflon is so finely divided, typically a few microns in diameter, that it readily passes the mill screen. In a preferred embodiment, as shown in the FIGURE, Teflon powder is added to granulated Viton and the two substances are passed through the mill together. Teflon tends to act as a grinding aid with the granulated Viton and a substantial degree of mixing of the two substances is accomplished in this way as well.

Grinding is preferably carried out with some free liquid nitrogen in the mill. The presence of liquid nitrogen during the grinding step assures that local heating of polymer particles does not occur. Consequently, at the end of a grinding run, the collection vessel may contain at least some liquid nitrogen. That liquid nitrogen must be removed before good mixing can be accomplished. Liquid nitrogen, like any other liquid, will form a meniscus between particles with the resulting capillary forces strongly holding the particles together in much the same fashion as water holds damp beach sand together.

Removal of liquid nitrogen from the particulates in the collection vessel is most easily accomplished by allowing the liquid nitrogen to evaporate while maintaining the system at atmospheric, or slightly higher than atmospheric, pressures. In a preferred embodiment, the collection vessel is so designed as to function also as a mixing vessel. In this case, provision must be made for maintaining the mixing vessel closed to the atmosphere while allowing the venting of nitrogen gas from the vessel to avoid pressure buildup as residual liquid nitrogen evaporates and the nitrogen gas expands upon warming.

Rotation of the collection-mixing vessel in an end-over-end fashion serves to provide good mixing of the particulate substances within the closed vessel. If the mixing is performed in ambient temperature surroundings, as is preferred, then heat transfer from the atmosphere ensures that no liquid nitrogen long remains in the mixing vessel. It is preferred that the temperature within the mixing vessel be monitored and this may conveniently be accomplished by means of a thermocouple. Liquid nitrogen boils at about −196° C. and by the time the gas temperature within the mixing vessel rises to about −160° to −170° C., all of the liquid on and between particles has been vaporized. At this point, the particle surfaces have an adsorbed layer or layers of nitrogen molecules and the entire particle mass within the mixing vessel is completely free flowing and, in visual appearance, is similar to a fluidized bed. As the temperature continues to rise, nitrogen gas is vented as is depicted in the FIGURE.

It is preferred that mixing be continued as the temperature within the mixer rises. At a temperature generally about −100° C. to −110° C., the character of the particle movement or flow within the mixing vessel changes quite dramatically. At this temperature range, the adsorbed monolayer of nitrogen is being driven off the particle surfaces allowing the normal inter-particle forces to come into play. The mixture tends to agglomerate and, at this stage, mixing may be stopped and the batch allowed to warm to room temperature. Venting of nitrogen from the mixing vessel continues during warmup as is shown in the FIGURE. At room temperature, the MTV composition has the appearance and texture of rubber crumb. It can be handled, stored, or transported in this form without segregation.

Lastly, the MTV composition must be formed into useable shapes and this is most conveniently done by extrusion into strands or by molding into desired shapes. Extrusion may be accomplished using a ram extruder at temperatures ranging from about 250° F. to 550° F. and pressures ranging from about 3,000 to 15,000 psi. Appropriate conditions of temperature and pressure for extrusion depend to a large extent upon the MTV formulation. In general, the higher the Viton content, the lower is the temperature or pressure required to extrude the composition. Pyrotechnic compositions of this type may include from 0 to 20% or more Viton, from about 20% to about 70% magnesium with the balance comprising Teflon. While the process flow diagram depicted in the FIGURE represents a batch process, each and all of the process steps can be carried out in a continuous fashion as well.

The FIGURE illustrates but one preferred use of the process. Minor adaptations of the depicted process allows its use in the production of polymer-explosive compositions which find use as gun propellant charges and have come to be known as low vulnerability ammunition (LOVA). These compositions comprise generally a major amount of a finely powdered high explosive such as RDX and a minor amount of an elastomer binder, typically a rubber such as Hycar 4004. The ratio of explosive to binder is typically about 3 to 1.

The process finds use in mixing a host of other finely divided substances as well. For example, in the manufacture of tungsten carbide shapes, it is required that tungsten carbide powder be mixed with a powdered metal binder, typically cobalt, along with other binders which may be polymers, with extrusion aids such as waxes, and with other special purpose additives. The mixed composition is extruded or pressed to a green body which is sintered at high temperature to form the final product. Uniformity of mixing is of critical importance in obtaining quality sintered pieces. The process of this invention is uniquely adapted for producing uniform mixtures of unlike substances such as are commonly encountered in powder metallurgy.

The following examples will serve to illustrate specific embodiments of this invention.

EXAMPLE 1

A quantity of hydroxy terminated polybutadiene was obtained. This material was a relatively low molecular weight prepolymer in the form of a viscous liquid at ambient temperatures. It was mixed with a liquid cross-linking agent, liquid bonding agent, and powdered ammonium sulfate in a weight ratio of about 80 parts ammonium sulfate and 20 parts of the other components. Ammonium sulfate is accepted in he art as an inert simulant for ammonium nitrate or ammonium perchlorate, the usual oxidizers in a composition of this sort. The mixture was chilled to cryogenic temperature using liquid nitrogen and was ground in a hammer mill continuously cooled with liquid nitrogen. The resulting powder was tumble mixed while warming until it was uniform and homogeneous.

The resulting powder blend was spread on a plate, allowed to warm, and placed in a vacuum oven for 48 hours at 120° C. Normal cure time for this particular system including a peroxide catalyst (not used in the experimental composition) is about 14 days at 80° C. At the end of 48 hours, the blend had the appearance and general consistency of a rubber crumb. A portion of this crumb-like material was placed into a mold and subjected to pressure and vacuum at ambient temperature for a period of 10 minutes.

A cylindrical disc was obtained substantially virtually free of voids and was substantially uniform throughout. The polymer binder was tough but elastic showing evidence of substantial degree of cross-linking.

EXAMPLE 2

A series of mixing experiments were performed using a spherical aluminum powder and cubic crystals of sodium chloride. A size analysis of the sodium chloride crystals was performed and it was found that the sample examined had a mean diameter of about 325 microns. The aluminum sample range from 25 to 63 microns in diameter with the mean being about 50 microns. Thus, the volume ratio of the average sodium chloride crystal to the average aluminum sphere was about 500 to 1.

Aluminum has a specified gravity of 2.71 while sodium chloride has a specific gravity of about 2.16. These differences in particle size, in particle shape and in specific gravity renders it difficult to obtain uniform admixtures of the two substances. Indeed, when tumble mixed at room temperature, the two materials would tend to segregate upon ceasing the mixing with the aluminum concentrating in the bottom of the mixing vessel.

In another experiment performed in accordance with the process of this invention, a mixture comprising PO wt. % aluminum powder and 80 wt. % sodium chloride crystal was place din a glass flask. The flask contents were chilled by addition of liquid nitrogen to the flask. The mass within the flask tended to stick together as an agglomerated clump when the flask was rotated with liquid nitrogen remaining. The liquid nitrogen was allowed to boil off until the gas temperature within the flask was about −130° C. At this temperature and in the absence of liquid nitrogen, only a few revolutions of the flask in an end-over-end manner were required to obtain a visually homogeneous mixture. The mixture was allowed to rise to room temperature and was then visually inspected under a microscope. Aluminum particles were observed clinging to the faces of the sodium chloride crystals.

EXAMPLE 3

A sample was prepared which contained 40% by weight of Teflon 7C and 54% by weight of spherical glass beads having a mean diameter of about 19 microns. Teflon 7C is a very finely divided powder described by its manufacturer as being a special molding powder for use where highest quality, void-free molding is required. It is generally processed by molding techniques including preforming followed by sintering. The glass beads are accepted in the art as being an appropriate inert simultant for spherical magnesium powder in formulations of this sort.

The mixture of Teflon powder and glass beads was chilled by addition of liquid nitrogen with stirring. The chilled mixture was then placed in a transparent plastic bag and shaken back and forth while allowing nitrogen gas to vent from the bag. As the liquid nitrogen evaporated, the mixture changed in character to a free flowing powder which was readily mixed in the plastic bag. After mixing, the bag was placed in running warm water which resulted in the bag contents forming a clumpy, rubber-like crumb. The crumb was then extruded into a ¼ inch diameter strand using a ram extruder at a temperature of 250° F. and an extrusion pressure of about 6,000 psi. The extruded strand was smooth and uniform but was fibrous in ross section. Individual fibers appeared under the microscope to comprise glass beads aligned in a Teflon matrix.

EXAMPLE 4

A MTV simulant formulation was prepared in the manner set out in the discussion of the drawing. It contained 16% Viton A, about 30% Teflon 7C powder and the balance spherical glass beads having a mean diameter of approximately 19 microns. Viton A is a fluoroelastomer copolymer of vinylidene fluoride and hexafluoropropylene. The glass beads, as was mentioned previously, are an accepted inert simulant for spherical magnesium particles of approximately the same diameter.

The Viton was chilled with liquid nitrogen and was granulated to a particle size smaller than ⅛ inch. The granulated Viton was mixed with the Teflon powder and liquid nitrogen was added to the mixture to chill it. The Viton-Teflon mixture was then passed through a hammer mill equipped with a 0.013 inch herringbone screen and additional liquid nitrogen was added directly to the mill to absorb the heat created by the grinding. All of the above steps were carried out in an inert atmosphere of nitrogen gas.

The Viton-Teflon mill product was collected in a double-walled vessel containing the glass beads. Liquid nitrogen in the annular area between the vessel walls maintained the particles within the vessel at a temperature near the boiling point of the liquid nitrogen. The double-walled collection vessel was of cylindrical shape and was provided with a removable top closure having venting and pressure relief means communicating from the vessel interior to the outside. At the conclusion of grinding, the top was secured to the collection vessel and the liquid nitrogen in the annular space between the vessel walls was drained. Temperatures within the vessel were monitored by use of two thermocouples; one located near the vessel top and the other located near the vessel bottom. The vessel was then attached to a rotatable cradle which was adapted to turn the vessel end-over-end. Nitrogen pressure from vaporizing liquid nitrogen was vented and the contents of the vessel were allowed to warm. So long as liquid nitrogen remained within the chamber, the temperature within the chamber remained essentially constant. A rising temperature then signaled the onset of proper mixing conditions; that is when all of the liquid within the chamber had evaporated leaving an adsorbed multilayer of nitrogen on the particle surfaces. The chamber was then rotated at a slow but constant rate as the vessel contents continued to warm. Nitrogen gas was periodically bled from the vessel interior as it expanded with warming. After mixing was complete, the vessel contents were allowed to warm to room temperature in the closed, nitrogen environment within the vessel.

The mixed product was in the form of agglomerates having the appearance and texture of a rubber crumb. It could be handled, inspected and transported without separation of the components. Microscopic inspection of the product showed glass beads dispersed quite uniformly throughout a matrix. It was not possible to distinguish between the Teflon and Viton particles making up the matrix. A ¼ inch strand was ram extruded at a temperature as low as 250° F. and pressures ranging from 5,200 to 6,000 psi. The extruded strands were smooth-surfaced, uniform and exceptionally strong. Samples of the extruded strands were used in density determinations and it was found that the extruded strands had an apparent density which was 97% of the calculated theoretical density.

EXAMPLE 5

High explosive compounds such as RDX are finding increasing use as components in gun propellants and also for use as rocket propellants. The high explosive in finely divided form is compounded with an elastomer such as Hycar 4004, which is a butyl acrylate rubber. Compounding is presently accomplished by dissolving the elastomer in an appropriate solvent, adding the other ingredients, which typically include a cross-linking agent and an extrusion aid such as graphite, along with the high explosive and mixing the substances together until homogeneity is achieved. The mixture is then carefully heated to evaporate the solvent and the resulting product is typically extruded to form an axially perforated strand which is chopped into short lengths for use as a gun propellant.

It is accepted in the art that confectioner's sugar is an appropriate inert simulant for RDX and other high explosives for experimental compounding with elastomer binders. Confectioner's sugar is finely ground crystalline sucrose with about 3% starch added as an anti-caking agent. In accordance with the generalized flow sheet set out in the drawing, a quantity of Hycar elastomer was chilled with liquid nitrogen and was granulated to a maximum particle size of about ⅛ inch. The granulated Hycar was mixed with confectioner's sugar and graphite in amounts to give about 75% sugar, 24% Hycar and 1% graphite. The mixture was then ground in a hammer mill in the manner described in Example 4 and was then further mixed in the collection vessel in accordance with the procedure of Example 4. After warming to room temperature, the product appeared to be a uniform gray crumb rubber. It was extruded into axially perforated strands through use of a twin screw extruder. The extruded strands were of consistently high quality.

As has been demonstrated by experimental example, the process of this invention is broadly useful in the mixing of all microscopically sized particulate substances which are solid at mixing conditions; i.e., which have a freezing or solidification point at a temperature of about −100° C. or higher. The adsorbed nitrogen layer on the particle surfaces at mixing conditions shields or cancels all inter-particle forces leaving only particle size and specific gravity of the different substances to affect the uniformity of the mixing procedure. Because the adsorbed nitrogen layer tends to act as an extension of the particle itself, small particles tend to act as if they are larger and particles of high specific gravity tend to act as if their effective specific gravity was less. Warming up a homogeneous mixture of different substances while maintaining an inert atmosphere allows interparticle forces to again come into play thus stabilizing the mixture and preventing segregation.

We claim:

1. A process for mixing unlike microscopic solid particles comprising:

dispersing said particles in cold nitrogen gas at conditions of temperature and pressure whereat at least a monolayer of nitrogen molecules is adsorbed on the surface of said particles;

physically admixing said particles for a time sufficient to obtain substantial homogeneity throughout the resulting mixture while maintaining the temperature and pressure such that said adsorbed layer of nitrogen is retained on the particle surfaces but that no liquid nitrogen may exist within the mixture; and thereafter removing said adsorbed nitrogen layer from the particle surfaces either by raising the temperature or by lowering the pressure, or both.

2. The process of claim 1 wherein said microscopic solid particles are selected from the group consisting of polymeric substances, elastomers, metals, inorganic salts, organic compounds and mixtures thereof.

3. A process for making a pyrotechnic composition of magnesium and a tetrafluoroethylene fluorocarbon polymer, comprising:

chilling finely divided particles of said tetrafluoroethylene fluorocarbon polymer to a temperature whereat at least a monolayer of nitrogen molecules can be adsorbed on the surfaces of said polymer particles;

dispersing said finely divided polymer particles by agitation in cold nitrogen;

chilling finely divided magnesium particles by direct contact with cold nitrogen;

mixing the polymer and magnesium particles in a nitrogen atmosphere for a time sufficient to obtain a substantially uniform distribution of the magnesium and polymer particles in the resulting mixture;

maintaining the temperature and pressure during the mixing step such that at least a monolayer of nitrogen is adsorbed on the surfaces of said polymer and magnesium particles but that no liquid nitrogen is in contact with said polymer and magnesium particles during mixing; and warming said mixture while maintaining it in a nitrogen atmosphere and forming the mixture into desired shapes by application of heat and pressure.

4. The process of claim 5, wherein magnesium comprises more than half of said mixture by weight.

5. The process of claim 3 wherein said mixture also contains a minor amount of a fluorinated elastomer.

6. The process of claim 5 wherein said fluorinated elastomer is present in said mixture in an amount less than 20% by weight.

7. The process of claim 6 wherein said fluorinated elastomer is a copolymer of vinylidene fluoride and hexafluoropropylene.

8. The process of claim 5 wherein said fluorinated elastomer is comminuted by grinding at liquid nitrogen temperatures.

9. The process of claim 8 wherein said polymer particles are passed through grinding means with said fluorinated elastomer.

10. The process of claim 5 wherein said mixture is formed into strands by extrusion.

11. The process of claim 10 wherein said extrusion is accomplished using a ram extruder at extrusion temperatures ranging from about 250° F. to about 550° F.

12. In a process for mixing microscopic solid particles of two or more unlike substances together, the improvement comprising:

conducting said mixing in a nitrogen atmosphere at conditions of temperature and pressure whereat at least a monolayer of nitrogen molecules is adsorbed on the particle surfaces but whereat no liquid nitrogen is present during the mixing.

13. The process of claim 12 wherein said microscopic solid particles are selected from the group consisting of polymers, elastomers, metals, inorganic salts, organic compounds and mixtures thereof.

14. A process for mixing microscopic solid particles of two or more unlike substances comprising:

dispersing particles of each of said substances in cold nitrogen at conditions of temperature and pressure whereat at least a monolayer of nitrogen molecules is adsorbed on the surfaces of said particles;

physically admixing said particles for a time sufficient to obtain substantial homogeneity throughout the resulting mixture while maintaining the temperature and pressure such that said particles retain said adsorbed layer of nitrogen but that no liquid nitrogen is present with said particles during mixing; and allowing the mixture to warm while maintaining it in a nitrogen atmosphere.

15. The process of claim 14 wherein said particles are dispersed in liquid nitrogen and wherein all of the liquid nitrogen is caused to vaporize before the particles are mixed together.

16. The process of claim 14 wherein said particles are dispersed by interaction with a moving stream of cold nitrogen gas.

17. The process of claim 14 wherein one of said substances is a polymer.

18. The process of claim 17 wherein said polymer is an elastomer and at least one of said other substances is selected from the group consisting of oxidizing agents, high explosive compounds, metals, and mixtures thereof.

19. The process of claim 17 wherein said polymer is an elastomer and wherein one of said unlike substances is a high explosive compound.

20. The process of claim 19 wherein the ratio of said elastomer to said high explosive is about 1 to 3 and wherein said mixture is formed into a desired shape by extrusion.

21. The process of claim 17 wherein said polymer is an elastomer and wherein said other unlike substances comprise an oxidizing salt.

22. The process of claim 21 wherein said oxidizing salt is selected from the group consisting of ammonium nitrate and ammonium perchlorate.

23. The process of claim 17 wherein said polymer is Teflon and wherein one of said other unlike substances is spherically shaped magnesium powder.

24. The process of claim 23 wherein another of said unlike substances comprises a fluorinated elastomer.

* * * * *